US007358454B2

(12) United States Patent
Senzui

(10) Patent No.: US 7,358,454 B2
(45) Date of Patent: Apr. 15, 2008

(54) KEY SHEET

(75) Inventor: Akira Senzui, Tokyo (JP)

(73) Assignee: Polymatech Co. Ltd., Tokyo (JP)

( * ) Notice: Subject to any disclaimer, the term of this patent is extended or adjusted under 35 U.S.C. 154(b) by 12 days.

(21) Appl. No.: 11/600,848

(22) Filed: Nov. 17, 2006

(65) Prior Publication Data

US 2007/0125629 A1 Jun. 7, 2007

(30) Foreign Application Priority Data

Nov. 18, 2005 (JP) ..... 2005-334085

(51) Int. Cl.
*H01H 3/12* (2006.01)

(52) U.S. Cl. ..... 200/341; 200/345

(58) Field of Classification Search ..... 200/310–314, 200/512–517, 341–345, 5 A, 5 R; 345/168; 400/472

See application file for complete search history.

(56) References Cited

U.S. PATENT DOCUMENTS 7,034,235 B2 * 4/2006 Hosaka ..... 200/314
7,138,588 B2 * 11/2006 Soumi ..... 200/5 A
7,262,379 B2 * 8/2007 Nishimura et al. ..... 200/314
2006/0196759 A1 * 9/2006 Soumi ..... 200/341
2007/0084710 A1 * 4/2007 Koyano et al. ..... 200/341

FOREIGN PATENT DOCUMENTS

JP 2004-319396 11/2004
JP 2004-362891 12/2004

* cited by examiner

*Primary Examiner*—Elvin Enad
*Assistant Examiner*—Lisa Klaus
(74) *Attorney, Agent, or Firm*—Rader Fishman & Grauer PLLC

(57) ABSTRACT

Provided is a stable key sheet in which, even if a key top is operated so as to be shifted sidewise, no excessive change, such as great tottering of the key top or overlapping of key tops each other, is caused. A key sheet including: a key top having a fixation protrusion protruding from a center of a bottom surface; and a base sheet to which the fixation protrusion is fixed, further includes a stopper plate having an opening through which the fixation protrusion of the key top is passed and whose edge faces a side of the fixation protrusion, in which, at a time of sidewise movement of the key top, the stopper plate abuts the key top to regulate the sidewise movement of the key top.

24 Claims, 15 Drawing Sheets

KEY SHEET

BACKGROUND OF THE INVENTION

1. Field of the Invention

The present invention relates to a pushbutton switch key sheet for use in an operating portion of various electric/electronic apparatuses, such as a mobile phone, a PDA, a car navigation apparatus, and a car audio apparatus, and more particularly, to a key sheet suitable for use in a structure in which one or two or more key tops are exposed through one operational opening provided in the casing of an apparatus.

2. Description of the Related Art

A pushbutton switch is known in which, as in a case of a mobile phone (101) shown in FIG. 14, due to a demand for a reduction in the size of the operating portion and from the viewpoint of artistic design property, a plurality of key tops (103) of a key sheet (102) are exposed in a clustered state through a single operational opening (101*b*) formed in a casing (101*a*). In the key sheet (102), a base sheet (104) for retaining the key tops (103) is formed solely of a flexible rubber-like elastic material, such as silicone rubber, so when, during use, the mobile phone (101) is, for example, set upright or laid face down as shown in FIG. 15, the base sheet (104) may suffer overall distortion due to the weight of the key tops (103). Then, a positional deviation may occur between pushers (104*a*) of the base sheet (104) and metal belleville springs (105*a*) provided on a board (105), resulting in a faulty operation state in which it is impossible to effect input if the key tops (103) are depressed.

To solve this problem, the present applicant has proposed, for example, in the document of JP 2004-319396 A, a key sheet (112) as shown in FIG. 16, and in the document of JP 2004-362891 A, a key sheet (122) as shown in FIG. 17. Those key sheets (112, 122) are equipped with a base sheet (114, 124) whose base portion (114*a*, 124*a*) formed of a rubber-like elastic material is reinforced by a reinforcing portion (114*b*, 124*b*) composed of a reinforcing member, such as a resin film or a hard resin plate, so even if the mobile phone (101) is laid face down, no distortion of the key sheet (112, 122) is generated.

Thus, in the key sheet (112, 122) equipped with the reinforcing portion (114*b*, 124*b*), it is possible to prevent generation of overall distortion of the key sheet (112, 122). However, as in a case of so-called oblique depression, in which a key top (113, 123) is depressed obliquely downwards, when a sidewise shifting force is applied to the key top (113, 123) of, for example, the key sheet (122), the key top (123) may be greatly tottered sidewise as shown in FIG. 18, or key tops (123) may overlap as shown in FIG. 19.

SUMMARY OF THE INVENTION

The present invention has been made with a view toward solving the problem of great tottering or overlapping of the key tops. It is therefore an object of the present invention to provide a stable key sheet in which, even if a key top is operated so as to be shifted sidewise, no excessive change, such as great tottering of the key top or overlapping of key tops, is caused.

To achieve the above-mentioned object, the present invention provides a key sheet, including: a key top having a surface portion exposed through an operational opening formed in a casing of an apparatus, and a fixation protrusion protruding from a center of a bottom surface of the surface portion; and a base sheet which is formed of a rubber-like elastic material and which is equipped with a movable membrane, to which the fixation protrusion is fixed and which float-supports the key top to allow displacement of the key top through depression, and a support leg placed on a board, characterized by further including a stopper plate having an opening through which the fixation protrusion of the key top is passed and whose edge faces a side of the fixation protrusion, in which, at a time of sidewise movement of the key top, the stopper plate abuts the key top to regulate the sidewise movement of the key top.

In the key sheet equipped with the key top having the surface portion exposed through the operational opening formed in the casing of the apparatus and the fixation protrusion protruding from the center of the bottom of the surface portion, and the base sheet formed of a rubber-like elastic material and having the movable membrane to which the fixation protrusion is fixed and which float-supports the key top to allow displacement of the key top through depression and the support leg placed on the board, there is provided the stopper plate through which the fixation protrusion of the key top is passed and which has the opening whose edge faces the side of the fixation protrusion, so it is possible to fix the key top and the base sheet to each other while arranging the stopper plate between the base sheet and the key top. Further, due to the provision of the stopper plate, which abuts the key top upon sidewise movement of the key top to regulate sidewise movement of the key top, any sidewise movement of the key top is regulated so that the key top is prevented from being greatly tottered. Still further, since the stopper plate is situated between the key top and the base sheet, it is possible to make it hard for the depressed key top to get under another key top adjacent thereto. Thus, it is possible to obtain a stable key sheet in which, even if a key top is depressed sidewise, there is involved no excessive change, such as a great tottering of the key top or the key top getting under another key top.

Further, the present invention provides a key sheet, including: a key top exposed through an operational opening formed in a casing of an apparatus; and a base sheet which is formed of a rubber-like elastic material and which is equipped with a fixation protrusion protruding from a surface and fixed to the key top, a movable membrane float-supporting the key top to allow displacement of the key top through depression, and a support leg placed on a board, characterized by further including a stopper plate having an opening through which the fixation protrusion of the base sheet is passed and whose edge faces a side of the fixation protrusion, in which, at a time of sidewise movement of the key top, the stopper plate abuts the fixation protrusion to regulate the sidewise movement of the key top.

In the key sheet equipped with the key top exposed through the operational opening formed in the casing of the apparatus, and the base sheet formed of a rubber-like elastic material and having the fixation protrusion protruding from the surface and fixed to the key top, the movable membrane float-supporting the key top so as to allow displacement of the key top through depression, and the support leg placed on the board, there is provided the stopper plate through which the fixation protrusion of the base sheet is passed and which has the opening whose edge faces the side of the fixation protrusion, so the sidewise movement of the key top is regulated to prevent great tottering of the key top. Further, since the stopper plate is situated between the key top and the base sheet, it is possible to make it hard for the depressed key top to get under another key top adjacent thereto. Thus, it is possible to obtain a stable key sheet in which, even if a key top is depressed sidewise, there is involved no excessive change, such as great tottering of the key top or the key top getting under another key top.

According to the present invention, it is possible to provide a key sheet in which, at the time of sidewise movement of a key top, the fixation protrusion of the key top or the fixation protrusion of the base sheet abuts the opening edge of the stopper plate. Thus, if a key top is inadvertently depressed sidewise, the fixation protrusion abuts the opening edge of the stopper plate before the key top has been greatly deviated, so there is no fear of the key top being greatly tottered or getting under another key top. Thus, it is possible to obtain a stable key sheet.

Alternatively, it is possible to provide a key sheet in which the stopper plate is equipped with a threshold protrusion protruding from its surface to a position beside a key top and regulating sidewise movement of the key top. Since the stopper plate is equipped with the threshold protrusion protruding from its surface to the position beside the key top and regulating sidewise movement of the key top, even if the key top is inadvertently depressed sidewise, the key top abuts the threshold protrusion of the stopper plate before the key top has been greatly deviated, so there is no fear of the key top being greatly tottered or getting under another key top. Thus, it is possible to obtain a stable key sheet.

According to the present invention, it is possible to provide a key sheet in which the movable membrane of the base sheet is separated from the stopper plate at the time of depressing operation on a key top. Since the movable membrane of the base sheet is separated from the stopper plate at the time of depressing operation on the key top, the movable membrane can be deformed to a sufficient degree without being constrained by the stopper plate. Thus, the depressing operation on the key top can be performed reliably. This also applies to a case in which the opening of the stopper plate is diminished. When the opening of the stopper plate is diminished, not only is it possible to perform the depressing operation reliably, but also the key top quickly comes into contact with the opening edge of the stopper plate upon sidewise movement of the key top, so it is possible to obtain a stable key sheet in which there is no fear of the key top being greatly tottered or getting under another key top.

Further, according to the present invention, it is possible to provide a key sheet in which the opening of the stopper plate is larger than the fixation protrusion of the key top and smaller than the key top. Since the opening of the stopper plate is larger than the fixation protrusion of the key top and smaller than the key top itself, the stopper plate is held between the key top and the base sheet in the key sheet in which the fixation protrusion of the key top is fixed to the movable membrane of the base sheet, thus preventing detachment of the stopper plate without having to fix the stopper plate to the key top or the base sheet.

It is possible to provide a key sheet in which the stopper plate is placed on the base sheet without being fixed to the base sheet. Since the stopper plate is not fixed to the base sheet, the base sheet can undergo a change without being constrained by the stopper plate, thereby making it possible to perform depressing operation reliably on the key top through sufficient deformation of the movable membrane.

Further, in a key sheet according to the present invention, the stopper plate may be fixed to the support leg of the base sheet. Due to the fixation of the stopper plate to the support leg of the base sheet, it is possible to prevent positional deviation between the base sheet and the stopper plate. Further, if the support leg is fixed to the stopper plate, the movement of the movable membrane of the base sheet is not affected, so it is possible to ensure sufficient deformation of the movable membrane and to perform depressing operation reliably on the key top.

Alternatively, it is possible to provide a key sheet in which both the stopper plate and the base sheet have mounting holes to be fit-engaged with positioning protrusions provided on the casing of the apparatus. When both the stopper plate and the base sheet have mounting holes to be fit-engaged with positioning protrusions provided on the casing of the apparatus, it is possible to fix both the stopper plate and the base sheet in position by fit-engaging the positioning protrusions with the mounting holes of both the stopper plate and the base sheet. This makes it possible to prevent positional deviation between the stopper plate and the base sheet even if the stopper plate and the base sheet are not fixed to each other.

Further, it is possible to provide a key sheet in which the base sheet has a light shield layer on its surface. By providing a light shield layer on the surface of the base sheet and covering the portions between the key tops or the portion corresponding to the gap between the key tops and the operational opening of the apparatus with the light shield layer, it is possible to provide illumination type key tops involving no light leakage through those portions.

Further, it is possible to provide a key sheet in which the surface of the base sheet is level. By making the surface of the base sheet level, when providing various additional layers, such as a light shield layer and a coloring layer, on the surface of the base sheet, it is possible to easily form those layers by an ordinary printing method. Thus, it is possible to provide an inexpensive key sheet.

According to the present invention, it is possible to provide a stable key sheet which involves no excessive change in the key tops, such as great tottering or overlapping of the key tops.

The above description of the present invention should not be construed restrictively. The advantages, features, and uses of the present invention will become more apparent from the following description given with reference to the accompanying drawings. It should be understood that appropriate modifications not departing from the spirit of the present invention are all covered by the scope of the present invention.

DESCRIPTION OF THE PREFERRED EMBODIMENTS

Figure 1:
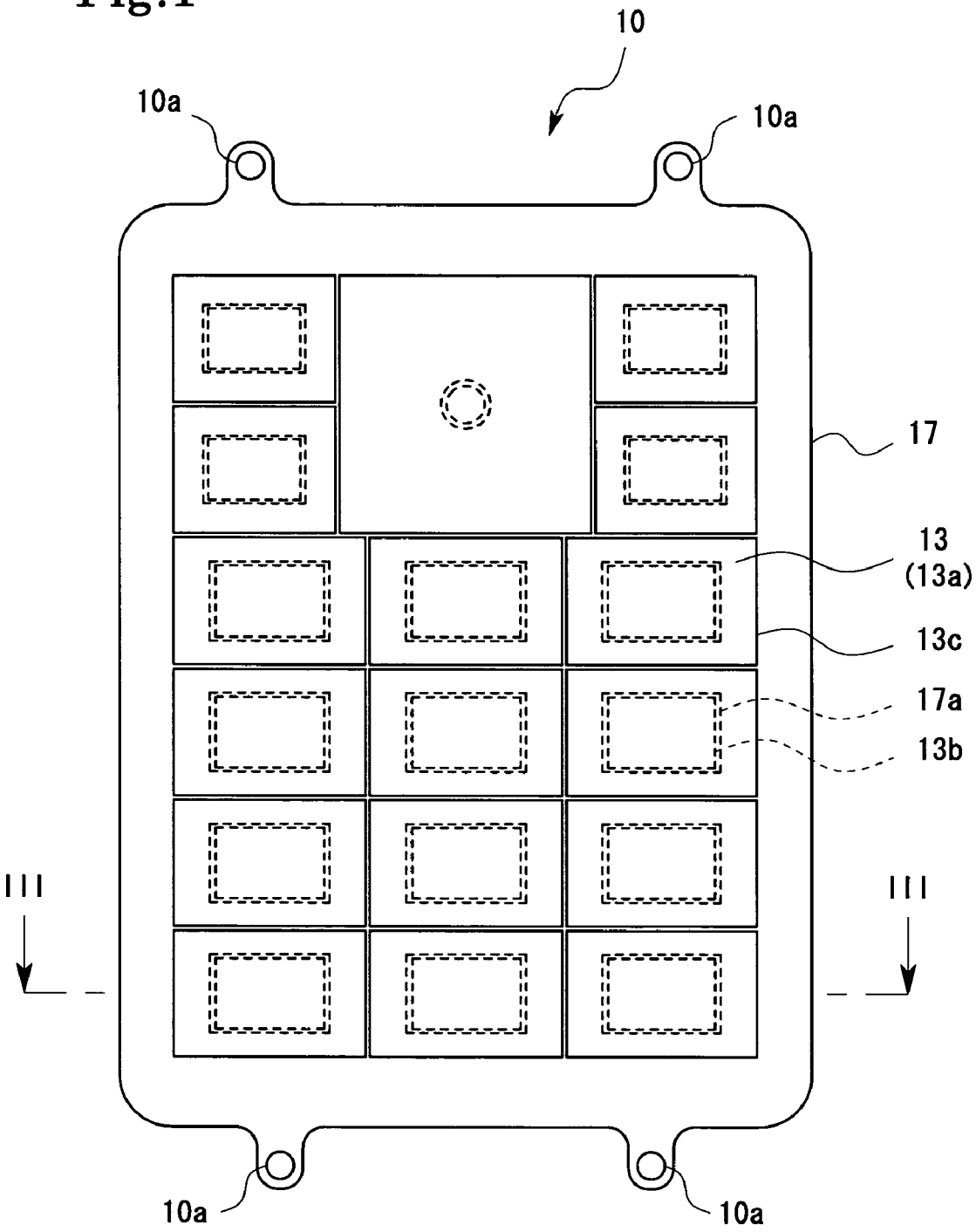
FIG. 1 is a plan view of a key sheet according to a first embodiment of the present invention.

In the following, embodiments of the present invention will be described with reference to the drawings. In the drawings, the reference numerals indicate portions and components. The components that are the same as those of the above-mentioned example and the components that are common to the following embodiments are indicated by the same reference numerals, and a redundant description thereof will be omitted. In the following description, a mobile phone (101) is taken as an example of an apparatus to which the pushbutton switch key sheet of the present invention is applied.

Figure 2:
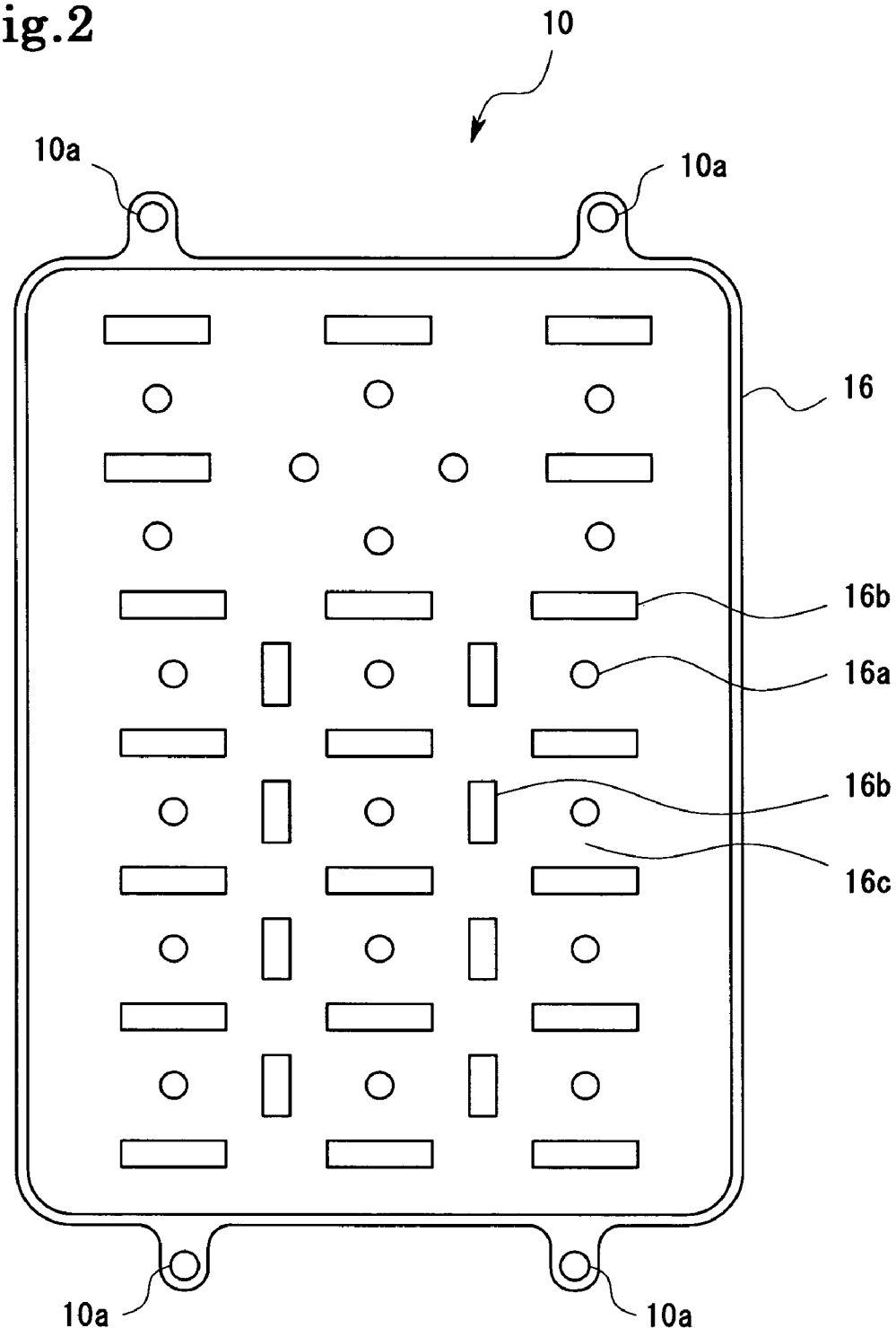
FIG. 2 is a bottom view of the key sheet of the first embodiment.
Figure 3:
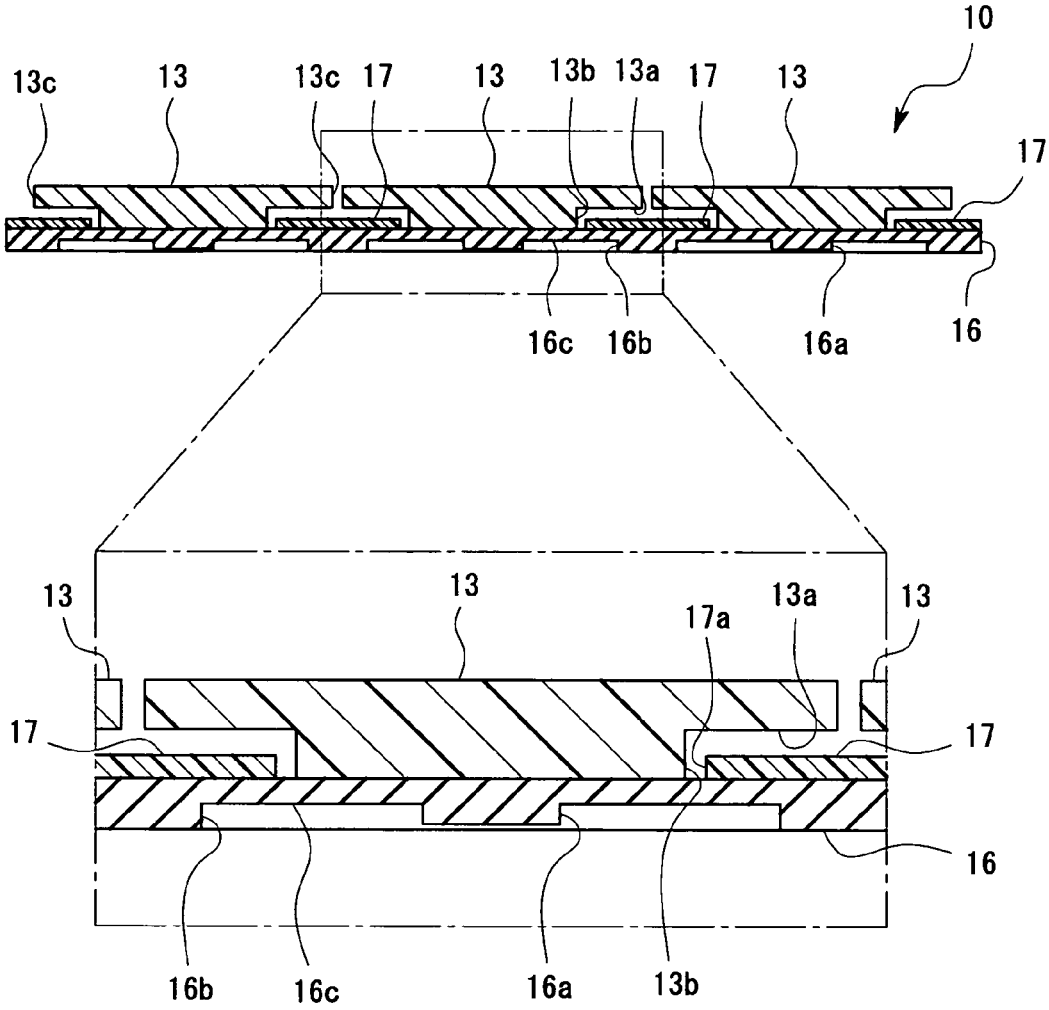
FIG. 3 is a sectional view of the key sheet taken along the line III-III of FIG. 1.

First Embodiment (FIGS. 1 through 3, and 8): FIGS. 1 and 2 are a plan view and a bottom view, respectively, of a key sheet (10) according to a first embodiment. FIG. 3 is a sectional view taken along the line III-III of FIG. 1. As shown in those drawings, the key sheet (10) of this embodiment is composed of key tops (13), a base sheet (16), and a stopper plate (17) provided between the key tops (13) and the base sheet (16).

Each key top (13) is a portion which exhibits a character, a symbol or the like and on which input operation is performed. The key top (13) is formed as an integral unit composed of a surface portion (13*a*) which constitutes the outer side of the key top (13) and which is exposed through a casing (101*a*) of the mobile phone (101) and a fixation protrusion (13*b*) which protrudes from the center of the bottom surface of the surface portion (13*a*). Usually, the key tops (13) are formed of a hard resin such as thermoplastic resin or thermosetting resin. However, they may also be formed of a rubber-like elastic material such as silicone rubber or thermoplastic elastomer. In the case of a so-called illumination type key top (13), a transparent material such as polycarbonate is used. Through surface decoration in outline type printing, it is possible to illuminate the character portion with light from a light source in the apparatus (101).

The base sheet (16) is formed of a rubber-like elastic material, its front surface is formed as a flat surface, and its bottom surface has pushers (16*a*) for depressing metal belleville springs (105*a*) provided on a board (105) such as a circuit board, and support legs (16*b*) placed on the board (105) and protruding from the flat bottom surface of the base sheet (16). The portions of the base sheet (16) fixed to the key tops (13) and the peripheral portion thereof constitute a movable membrane (16*c*) float-supporting the key tops (13) so as to allow displacement through depression.

Examples of the material to be used for the base sheet (16) include silicone rubber, and thermoplastic elastomers of a styrene type, an ester type, a urethane type, an olefin type, an amide type, a butadiene type, an ethylene vinyl acetate type, a vinyl chloride type, a fluoro-rubber type, an isoprene type, a chlorinated polyethylene type, and the like.

When the key top (13) makes an inadvertent sidewise movement, the stopper plate (17) abuts the key top (13) to regulate excessive sidewise movement of the key top (13). Here, the stopper plate (17) also functions as a reinforcing member for rectifying overall distortion of the key sheet (10). The stopper plate (17) is formed of a flat single plate having a plurality of openings (17*a*), and it is placed on the surface of the base sheet (16), with the fixation protrusions (13*b*) of the key tops (13) passed through the stopper plate (17) and the edges of the openings (17*a*) facing the sides of the fixation protrusions (13*b*). From the viewpoint of suppressing overall distortion of the key sheet (10), it is desirable for the material of the stopper plate (17) to be one of high rigidity, and is possible to use a thin metal plate, a hard polymer material or the like.

As the material of the thin metal plate, it is desirable to adopt stainless steel, aluminum or the like. This is because such materials are superior in workability, strength, rust resisting property, and heat conductivity, and further, it makes the key sheet (10) relatively free from generation of static electricity, thereby making it possible to prevent erroneous input. From the viewpoint of reinforcing the key sheet (10) as a whole, its thickness is preferably 0.1 mm or more, and from the viewpoint of avoiding excessive load on the key tops (13) for improved operability, its thickness is preferably 0.5 mm or less.

The hard polymer material has a bending modulus of elasticity of preferably 700 kgf/cm$^2$ or more, and more preferably 7,000 kgf/cm$^2$ or more. Examples of the hard polymer material include: a hard resin plate or a hard resin film composed of a polycarbonate resin, a polymethyl methacrylate resin, a polypropylene resin, a polystyrene resin, a polyacrylic copolymer resin, a polyolefin-based resin, an acrylonitrile butadiene styrene resin, a polyester-based resin, an epoxy-based resin, a polyurethane-based resin, a polyamide resin, and a silicone-based resin; and hard thermoplastic elastomers of an olefin type, a styrene type, an ester type, a urethane type, an amide type, and the like.

From the viewpoint of reinforcing the key sheet (10) as a whole, the thickness of the hard polymer material sheet is preferably 0.15 mm or more, and from the viewpoint of avoiding excessive depression load on the key tops (13) for improved operability, its thickness is preferably 1.5 mm or less. In particular, in the case of a hard resin plate, it may be a thin plate whose thickness ranges from 0.15 mm to 0.5 mm; in the case of thermoplastic elastomer, it may be a relatively thick plate whose thickness ranges from 0.5 mm to 1.5 mm.

In effecting bonding between the key tops (13), the base sheet (16), and the stopper plate (17), the fixation protrusions (13*b*) of the key tops (13) are passed through the openings (17*a*) of the stopper plate (17), and fixed to the movable membrane (16*c*) of the base sheet (16) by adhesive (not shown). In this way, the stopper plate (17) is placed on the surface of the base sheet (16) without being fixed to the key tops (13) and the base sheet (16). However, the openings (17*a*) of the stopper plate (17) are larger than the fixation protrusions (13*b*) of the key tops (13) and smaller than the surface portions (13*a*) of the key tops (13), so the stopper plate (17) is not detached from between the key tops (13) and the base sheet (16). The sidewise width of the fixation protrusions (13*b*) of the key tops (13) is slightly smaller than the width of the openings (17*a*). It is desirable for the distance between the ends of the fixation protrusions (13*b*) and the edges of the openings (17*a*) (width of the gaps between the fixation protrusions (13*b*) and the openings (17*a*)) to be 0.05 mm to 0.3 mm. Further, in the periphery of the key sheet (10), there are provided mounting holes (10*a*, 10*a*) extending through both the base sheet (16) and the stopper plate (17). Positioning protrusions provided on the apparatus (101) and formed of pins or the like (not shown) are passed through the mounting holes (10*a*, 10*a*) for fit-engagement, whereby the base sheet (16) and the stopper plate (17) are accurately fixed in position, and positioning is accurately effected on the key sheet (10) with respect to the apparatus (101) for fixation.

In producing the key sheet (10), the key tops (13), the base sheet (16), and the stopper plate (17) are each first molded in a predetermined configuration beforehand. Next, the plurality of key tops (13) are arranged at predetermined intervals by using an appropriate jig, and the stopper plate (17) is arranged on the bottom side of the key tops (13) while effecting positioning thereon. Then, adhesive is applied to the movable membrane (16*c*) of the base sheet (16) or the bottom surfaces of the fixation protrusions (13*b*) of the key tops (13). Subsequently, the base sheet (16) is opposed to the stopper plate (17) and the key tops (13), and bonding is effected such that the fixation protrusions (13*b*) and the movable membrane (16*c*) overlap, whereby the key sheet (10) is obtained.

Next, the operation and effects of the key sheet (10) will be described.

Figure 4:
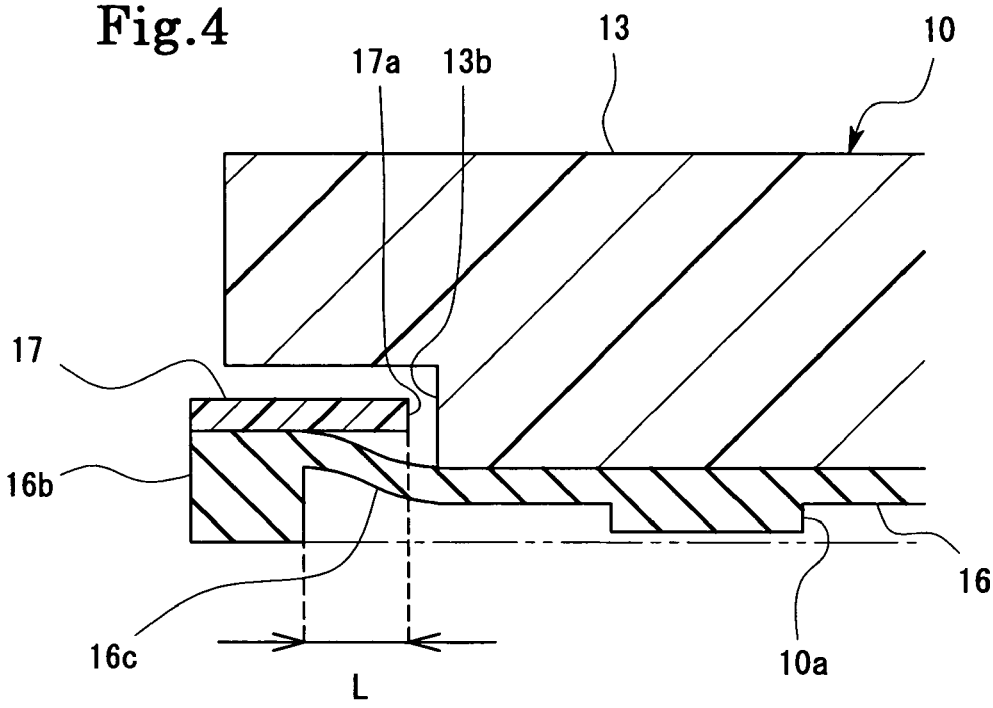
FIG. 4 is a schematic sectional view of the key sheet of the first embodiment when depressing operation is performed in the normal direction.
Figure 5:
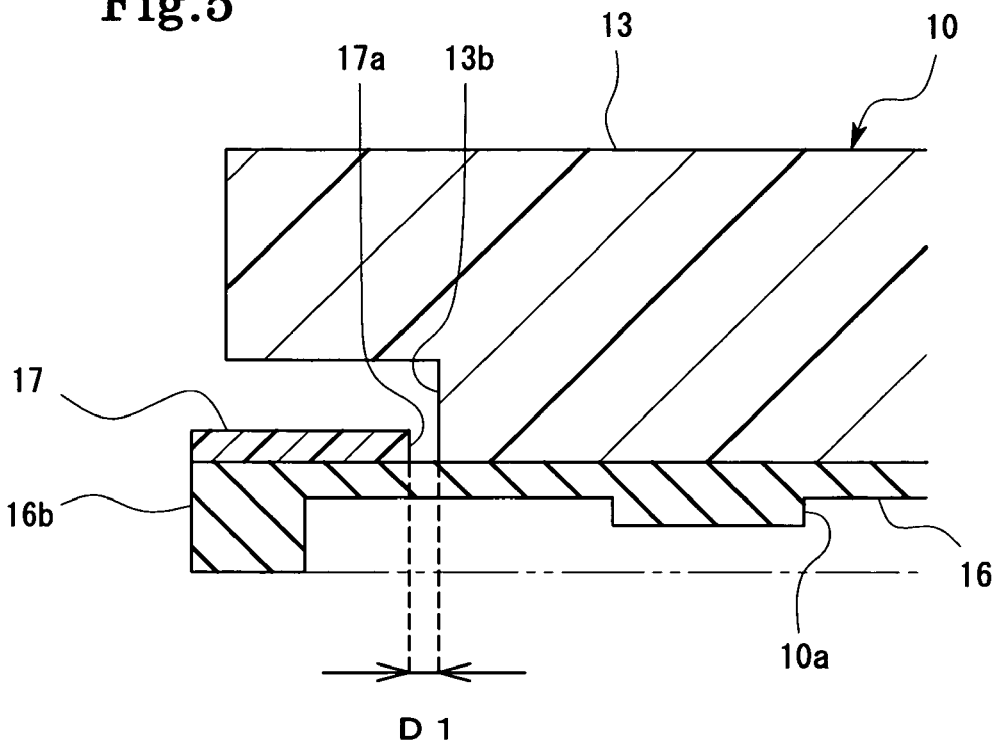
FIG. 5 is a schematic sectional view showing the distance between a key top of the key sheet of the first embodiment and a stopper plate.

As stated above, the base sheet (16) and the stopper plate (17) are not fixed to each other. Thus, when normal input operation is performed on the key top (13), that is, when the surface of the key top (13) is depressed perpendicularly to the horizontal direction, the base sheet (16) is not constrained by the stopper plate (17). Thus, as shown in FIG. 4, even in a case of a movable membrane (16*c*) which overlaps the stopper plate (17) in the depressing direction and whose width is larger than the opening (17*a*) by a dimension (L), the movable membrane (16*c*) is separated from the edge of the opening (17*a*) of the stopper plate (17), and is deflected sufficiently and expands, thereby allowing smooth input operation. In contrast, when an inadvertent sidewise depressing operation is performed on the key top (13), due to a small distance (D1) between the fixation protrusion (13*b*) and the edge of the opening (17*a*), displacement of the fixation protrusion (13*b*) by the distance (D1) results in its quickly coming into contact with the edge of the opening (17*a*) of the stopper plate (17) protruding from the surface of the base sheet (16), and no further sidewise movement is effected. Thus, no great tottering of the key top (13) is involved.

Figure 6:
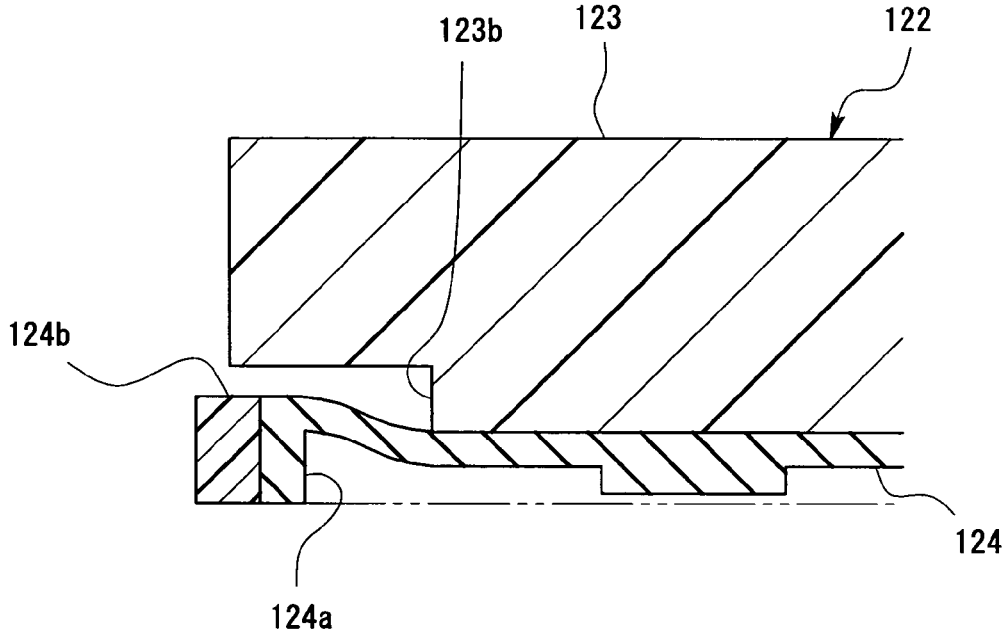
FIG. 6 is a schematic sectional view of a conventional key sheet when depressing operation is performed in the normal direction.
Figure 7:
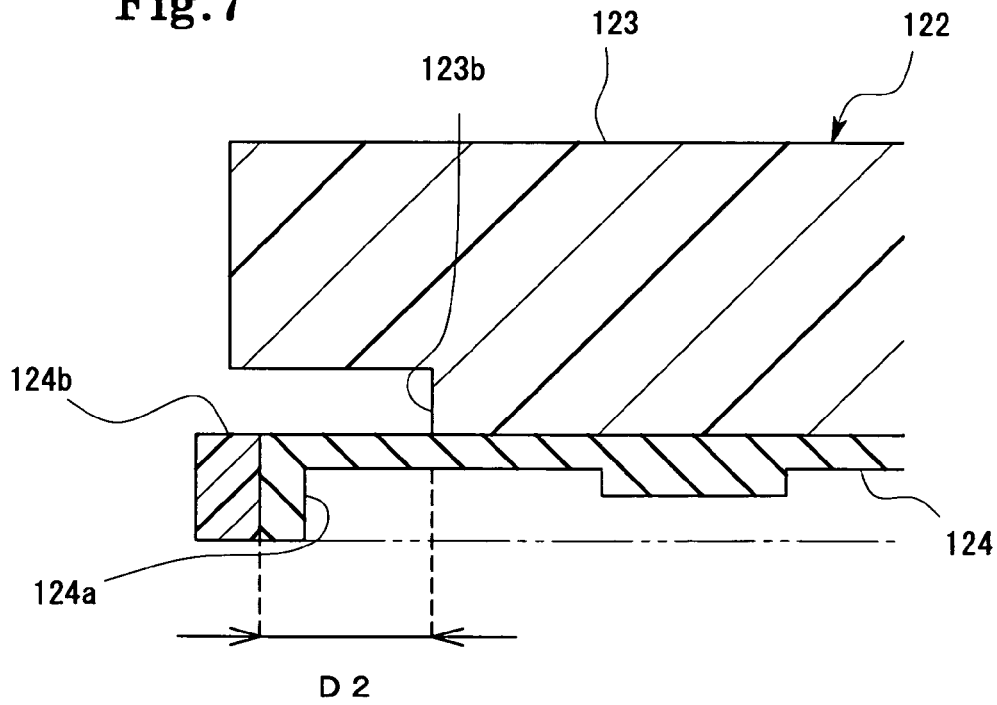
FIG. 7 is a schematic sectional view showing the distance between a key top of the conventional key sheet and a reinforcing portion.
Figure 17:
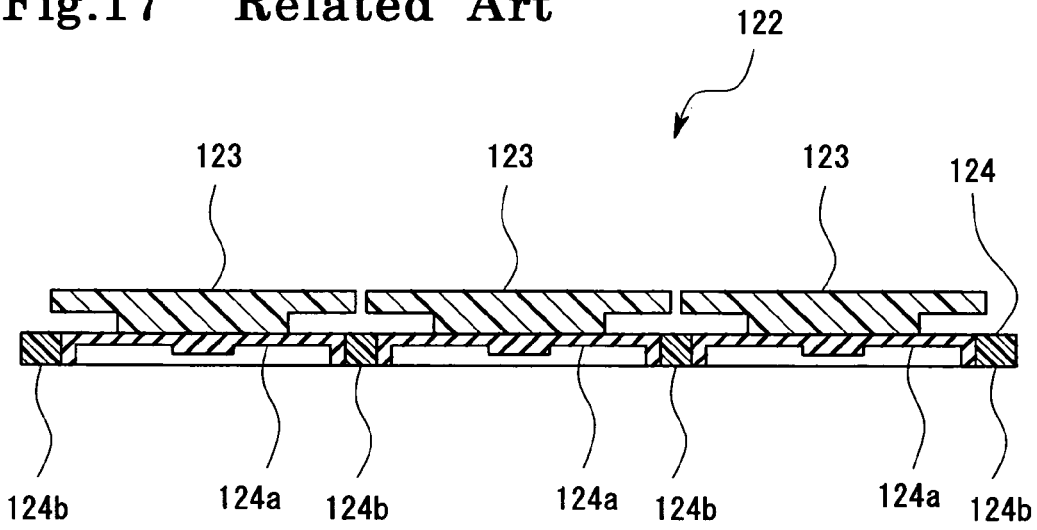
Fig.17 Related Art
FIG. 17 is a sectional view, corresponding to FIG. 3, of another conventional key sheet.
Figure 18:
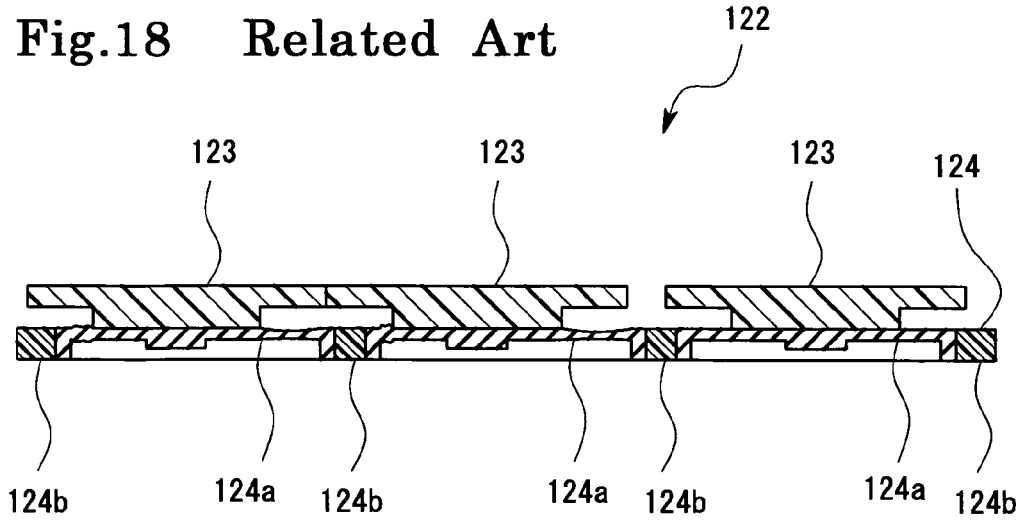
Fig.18 Related Art
FIG. 18 is a schematic sectional view of the conventional key sheet of FIG. 17 when a key top thereof is depressed sidewise.
Figure 19:
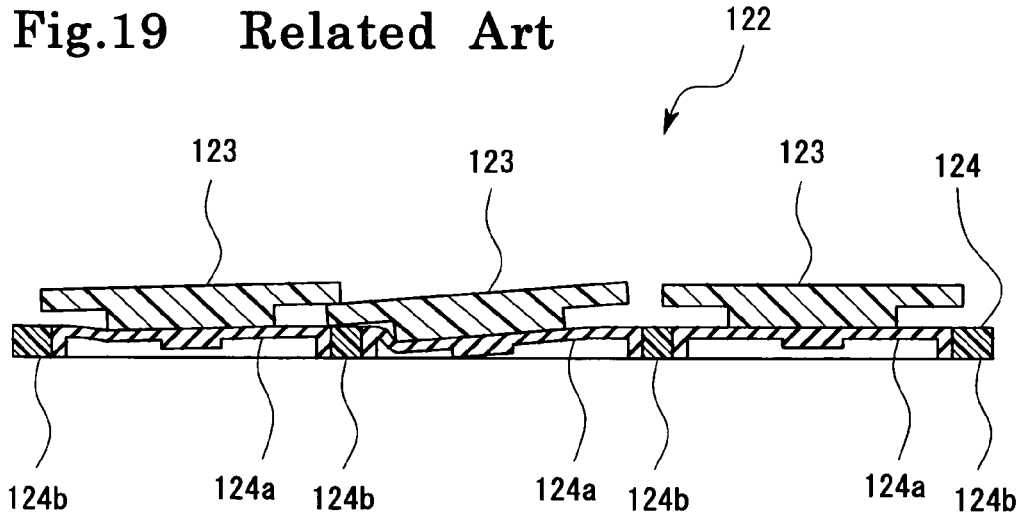
Fig.19 Related Art
FIG. 19 is a schematic sectional view of the conventional key sheet of FIG. 17 when an end of a key top thereof is depressed obliquely.

In this regard, a conventional key sheet (122) shown in FIG. 17 will be examined for comparison. As shown in FIG. 6, as far as the displacement of the movable membrane at the time of normal depressing operation is concerned, there is hardly any difference between the conventional key sheet and the key sheet (10). However, as shown in FIG. 7, when an inadvertent sidewise depressing operation is performed on the key sheet (122), due to a large distance (D2) between a fixation protrusion (123*b*) of a key top (123) and a reinforcing portion (124*b*), the fixation protrusion (123*b*) may be greatly displaced, and there is a fear of its being tottered sidewise. Thus, it will be understood that, as compared with the key sheet (122), the key sheet (10) is superior in tottering prevention.

Figure 8:
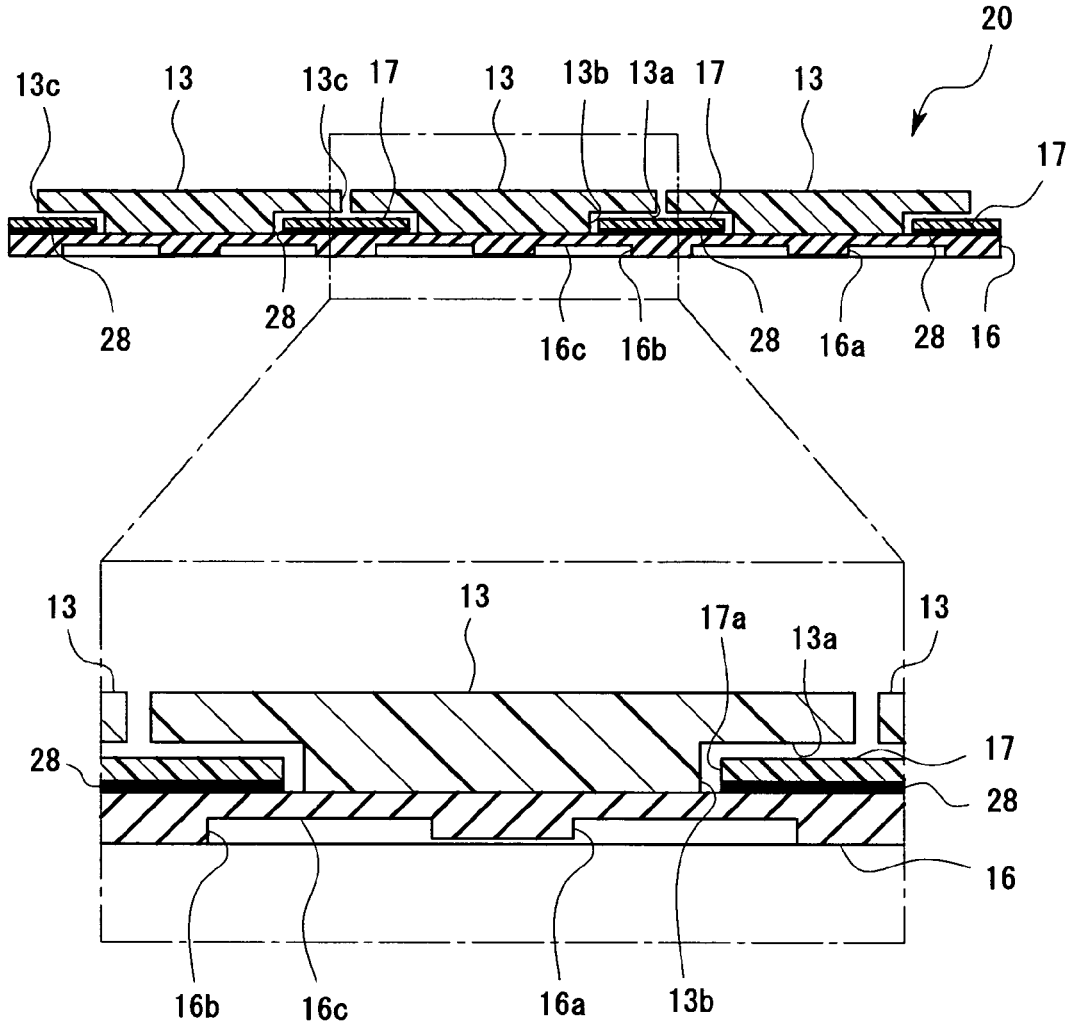
FIG. 8 is a sectional view, corresponding to FIG. 3, of a key sheet according to a modification of the first embodiment.

Next, FIG. 8 shows a modification of this embodiment. In a key sheet (20) shown in FIG. 8, a light shield layer (28) is provided on the surface of the base sheet (16). In the case of so-called illumination type key tops, there is no need to provide the light shield layer (28) if the stopper plate (17) is formed of a thin metal plate or the like that is lightproof, whereas, if the stopper plate (17) is formed of a transparent hard resin plate or the like, by providing the light shield layer (28), it is possible to provide a high quality key sheet (20) free from light leakage through the gaps between the key tops (13). Since the surface of the base sheet (16) is flat, the light shield layer (28) can be easily formed by an ordinary printing method using a lightproof ink.

Figure 9:
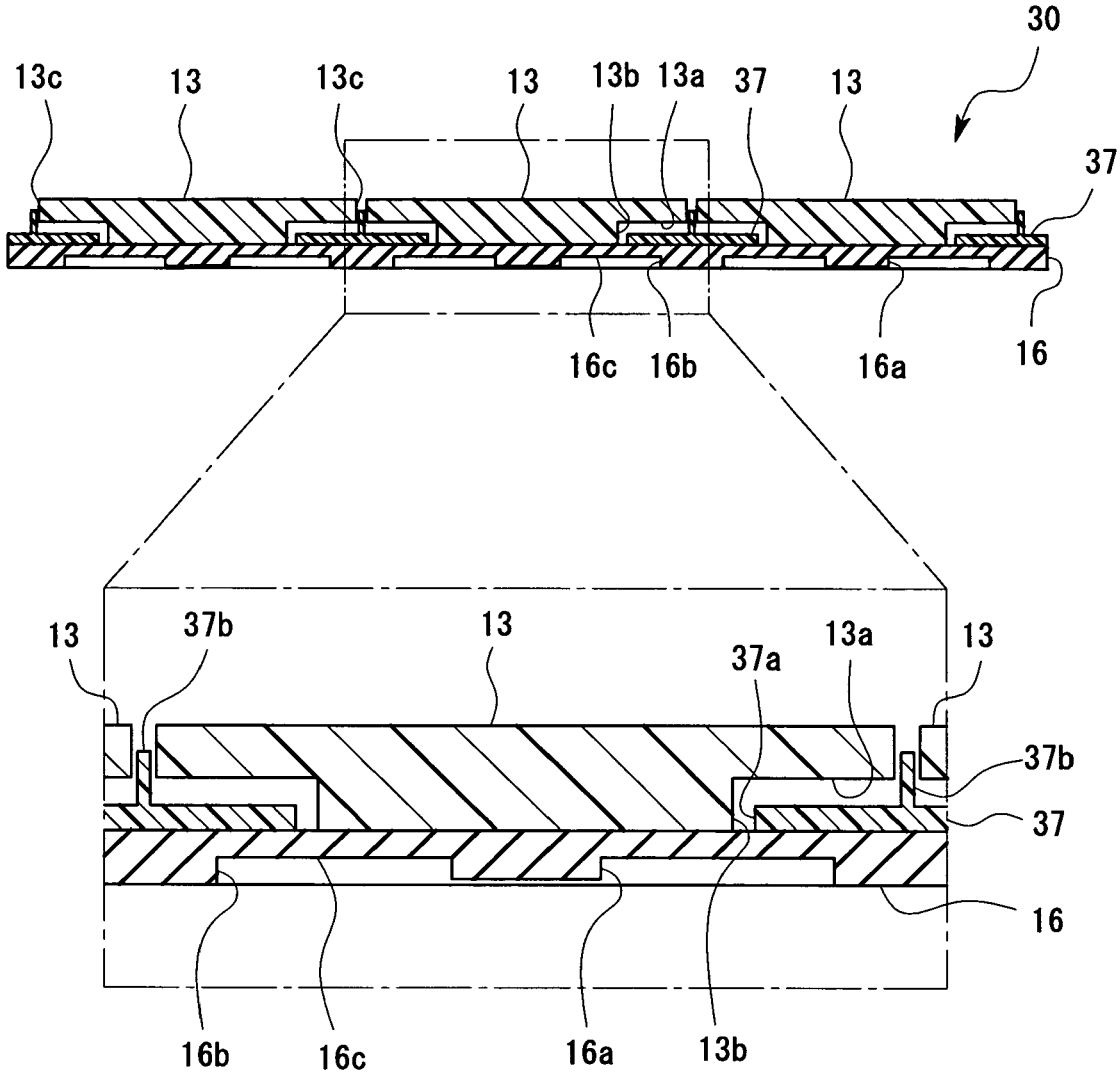
FIG. 9 is a sectional view, corresponding to FIG. 3, of a key sheet according to a second embodiment of the present invention.

Second Embodiment (FIG. 9): FIG. 9 is a sectional view of a key sheet (30) according to a second embodiment. The key sheet (30) differs from the key sheet (10) of the first embodiment in the configuration of a stopper plate (37). That is, the stopper plate (37) of the key sheet (30) has threshold protrusions (37*b*) which protrude in a plate-like form from its surface to positions beside the surface portions (13*a*) of the key tops (13) and the distal end of each of which is situated between the outer peripheral surfaces (13*c*) of two adjacent surface portions (13*a*). The stopper plate (37) can be easily obtained through injection molding of polymer material.

In the key sheet (30) with the stopper plate (37) described above, even if the distance between the edge of an opening (37*a*) provided in the stopper plate (37) and the fixation protrusion (13*b*) of the key top (13) is large, when an inadvertent sidewise operation is performed on the key top (13), the outer peripheral surface (13*c*) of the key top (13) quickly comes into contact with the threshold protrusion (37*b*) of the stopper plate (37) before the key top (13) has been greatly displaced, so it is possible to prevent the key top (13) from being greatly tottered or overlapping another key top (13).

Figure 10:
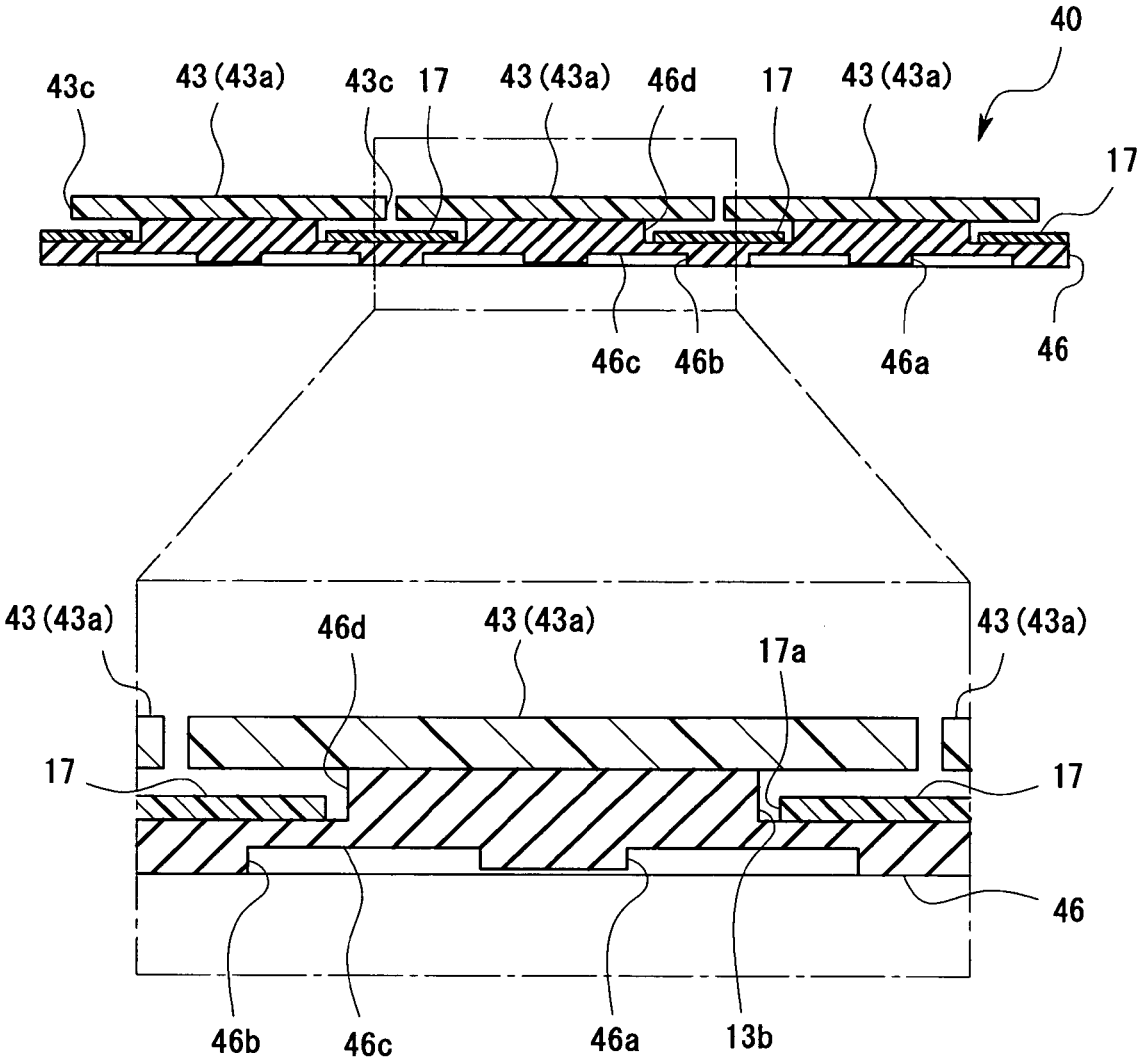
FIG. 10 is a sectional view, corresponding to FIG. 3, of a key sheet according to a third embodiment of the present invention.

Third Embodiment (FIG. 10): FIG. 10 shows a key sheet (40) according to a third embodiment. Unlike the key sheets (10, 20, 30) of the first and second embodiments, the key sheet (40) of the third embodiment has key tops (43) having no fixation protrusions and formed solely of surface portions (43*a*). The base sheet (46) has pedestal portions (46*d*) protruding from its surface and fixed to the key tops (43).

In the key sheet (40), when an inadvertent sidewise moving operation is performed thereon, the pedestal portion (46*d*) concerned abuts the stopper plate (17), so there is no fear of the key top (43) being greatly tottered or overlapping another key top (43).

Figure 11:
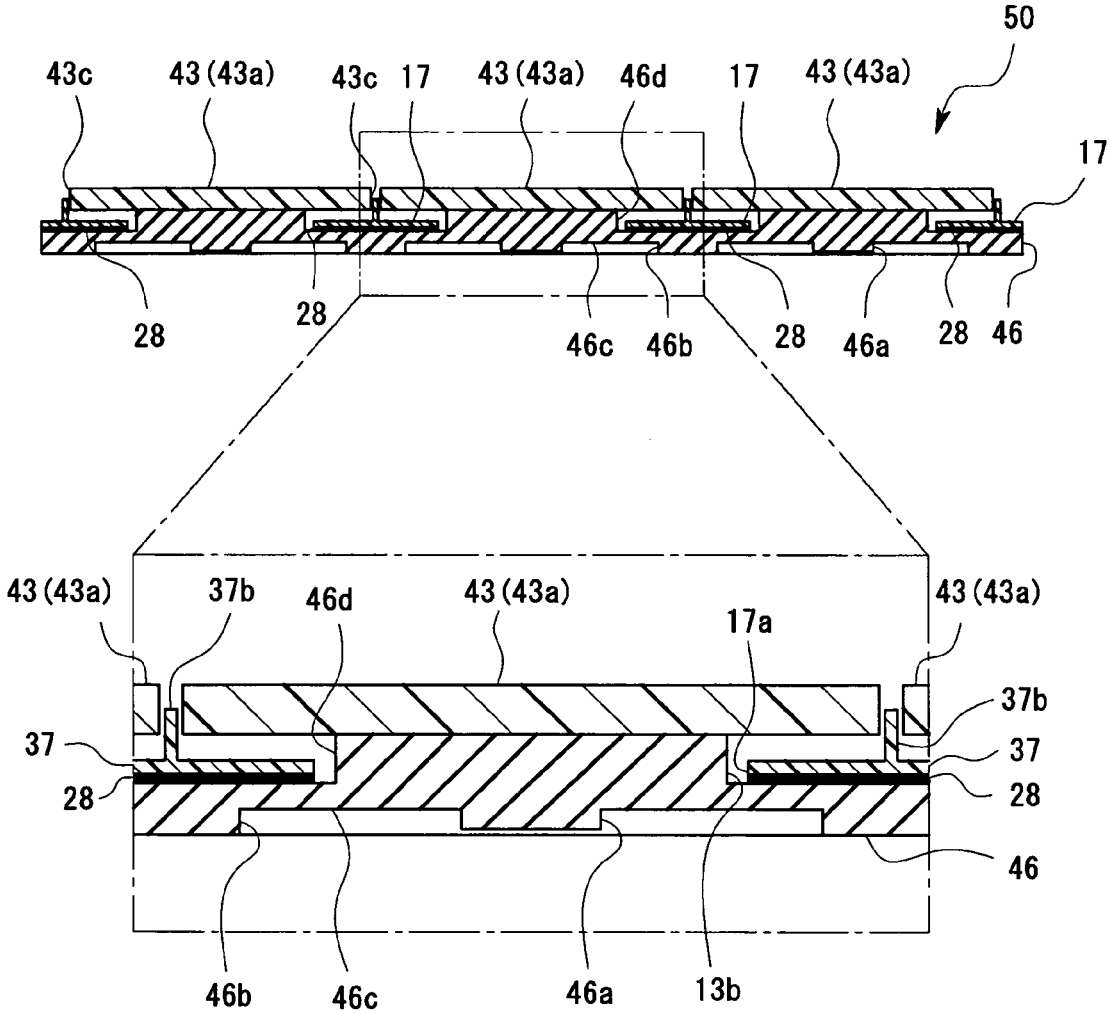
FIG. 11 is a sectional view, corresponding to FIG. 3, of a key sheet according to a fourth embodiment of the present invention.

Fourth Embodiment (FIG. 11): FIG. 11 shows a key sheet (50) according to a fourth embodiment. The key sheet (50)

differs from the key sheet (40) of the third embodiment in the configuration of the stopper plate (37) and the provision of the light shield layer (28) on the surface of the base sheet (46). That is, the stopper plate (37) of the key sheet (50) has threshold protrusions (37*b*) which protrude in a plate-like form from its surface to positions beside the surface portions (43*a*) of the key tops (43) and the distal end of each of which is situated between the outer peripheral surfaces (43*c*) of two adjacent surface portions (43*a*). The stopper plate can be formed through injection molding of a transparent hard resin, and is placed on the base sheet (46) through the intermediation of the light shield layer (28) provided on the surface of the base sheet (46). Since the surface of the base sheet (46) is flat, the light shield layer (28) can be formed by an ordinary printing method using an ink capable of intercepting light.

In the key sheet (50) with the stopper plate (37), even if the distance between the edge of the opening (37*a*) provided in the stopper plate (37) and the fixation protrusion (13*b*) of the key top (43) is large, when an inadvertent sidewise operation is performed on the key top (43), the outer peripheral surface (43*c*) of the key top (43) quickly comes into contact with the threshold protrusion (37*b*) of the stopper plate (37) before the key top (43) has been greatly displaced, so it is possible to prevent the key top (43) from being greatly tottered or overlapping another key top (43). Due to the provision of the light shield layer (28) on the surface of the base sheet (46), it is possible to provide the high quality key sheet (50) involving no light leakage through the gaps between the key tops (43) even if the stopper plate (37) is transparent.

Modifications of the Embodiments: While in the modification of the first embodiment the light shield layer (28) is provided on the base sheet (16), it is also possible to provide it on the stopper plate (17). Further, apart from the outline type printing, the formation of the display portion such as character or symbol on the key top (13), can be effected by various other well-known methods such as character printing on the front surface or the back surface of the key top (13).

Figure 12:
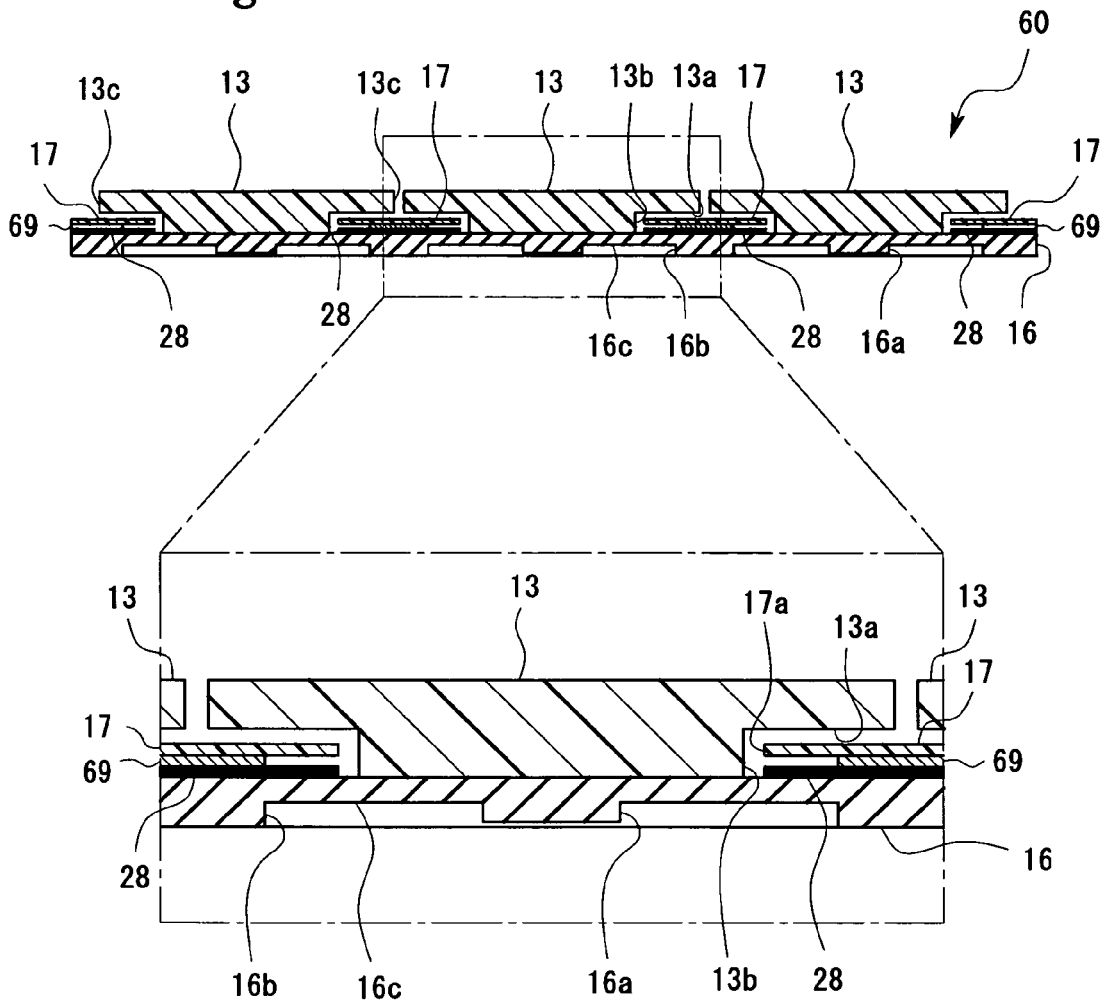
FIG. 12 is a sectional view, corresponding to FIG. 3, of a key sheet according to a modification of the first embodiment.
Figure 13:
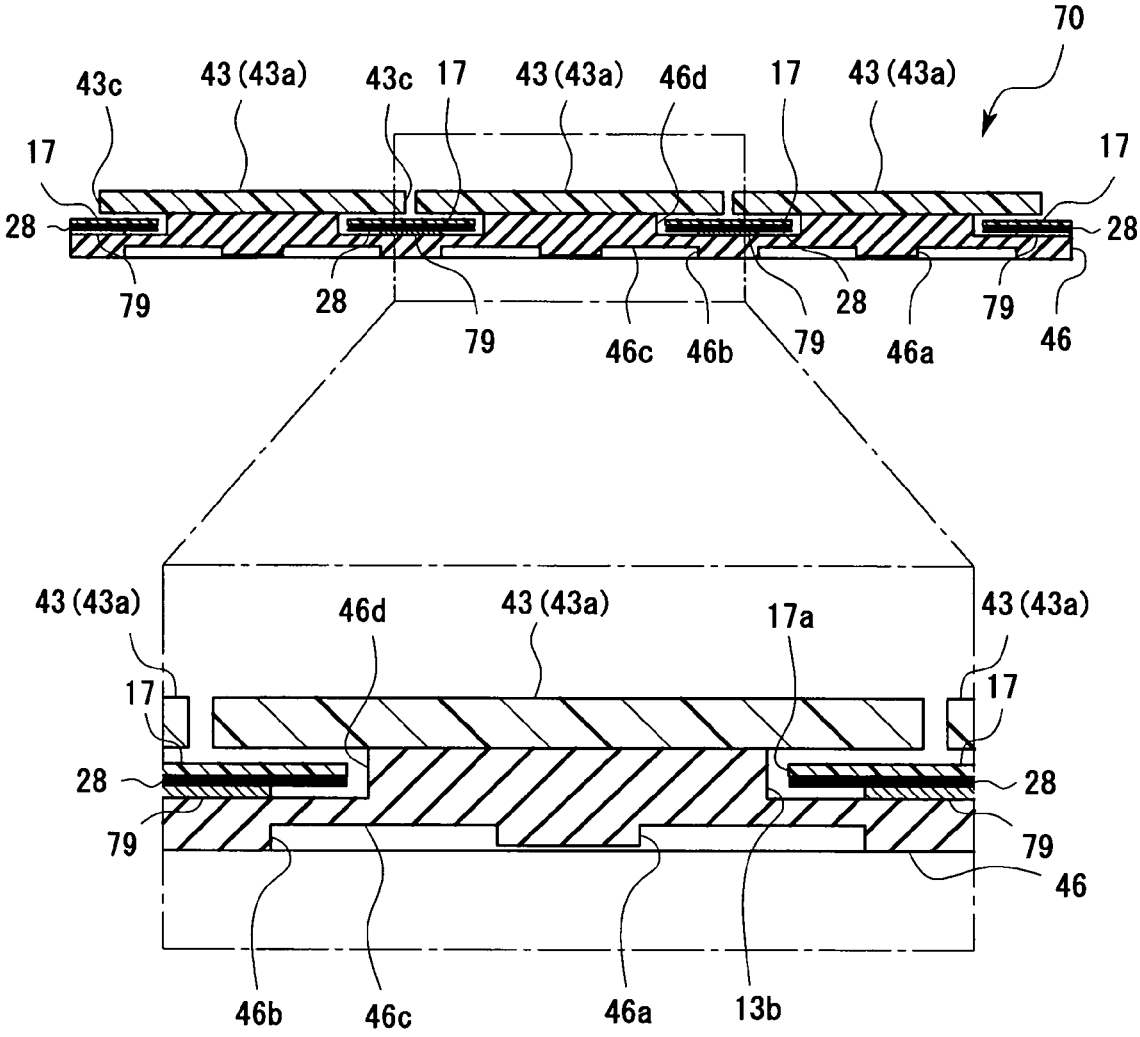
FIG. 13 is a sectional view, corresponding to FIG. 3, of a key sheet according to a modification of the fourth embodiment.
Figure 14:
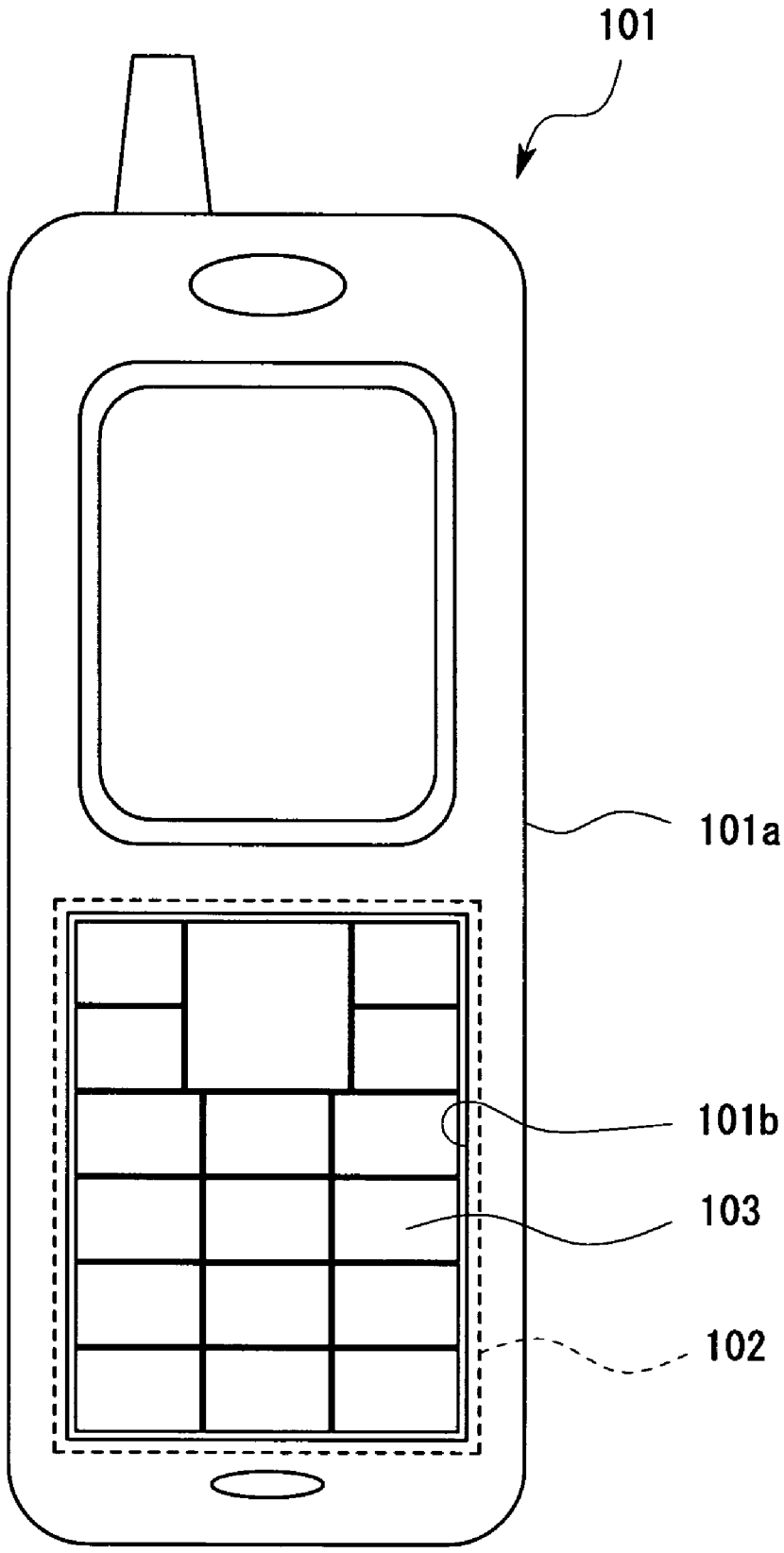
FIG. 14 is an external view of a mobile phone.
Figure 15:
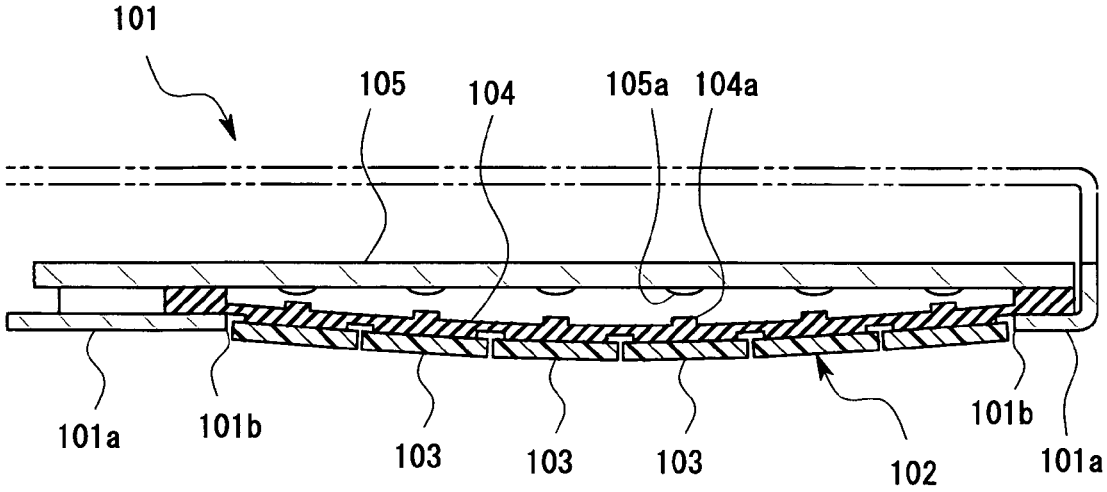
Fig.15 Related Art
FIG. 15 is a schematic sectional view of a mobile phone equipped with a conventional key sheet in a state in which it is laid face down.
Figure 16:
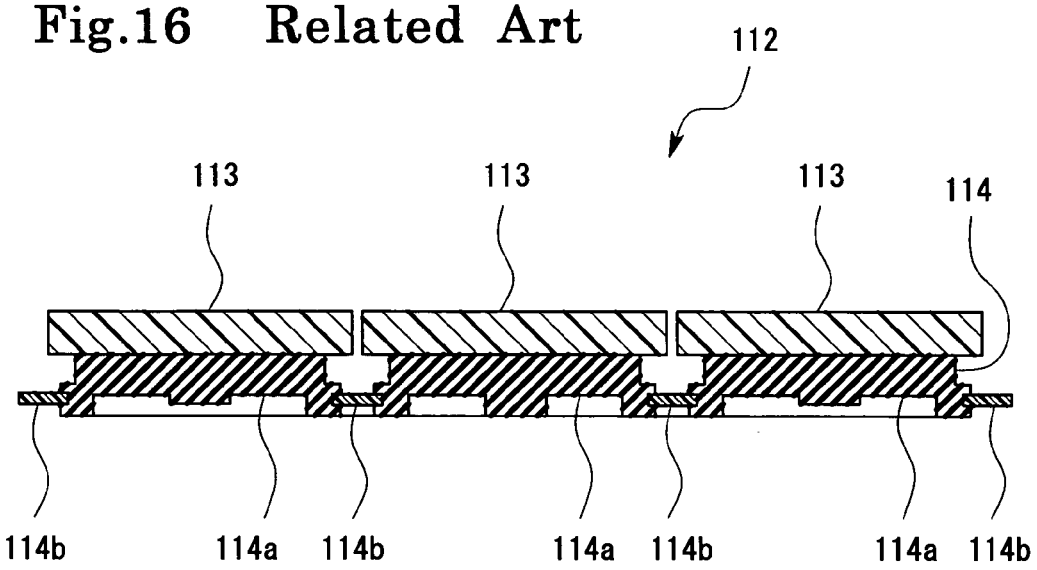
Fig.16 Related Art
FIG. 16 is a sectional view, corresponding to FIG. 3, of a conventional key sheet.

While in the above embodiments the stopper plate (17, 37) is not fixed to the base sheet (16, 46), it is also possible to fix the stopper plate (17, 37) to the portions of the front surface of the base sheet (16, 46) corresponding to the support legs (16*b*, 46*b*). For example, FIG. 12 shows a key sheet (60) according to a modification of the key sheet (20). In this key sheet, the stopper plate (17) is fixed to the portions of the surface of the light shield layer (28) corresponding to the support legs (16*b*) of the base sheet (16) by means of an adhesive layer (69). Further, FIG. 13 shows a key sheet (70) according to a modification of the key sheet (40). In this key sheet, the stopper plate (17) with the light shield layer (28) on the back surface is fixed to the portions of the surface of the base sheet (46) corresponding to the support legs (46*b*) by means of an adhesive layer (79). This helps to prevent positional deviation between the stopper plate (17) and the base sheet (16, 46).

While in the above embodiments the stopper plate (17, 37) also functions as a reinforcing member imparting overall rigidity to the key sheet (10, 20, 30, 40, 50, 60, 70), it is also possible to use a soft material not functioning to such a degree as to complement the rigidity of the key sheet (10, 20, 30, 40, 50, 60, 70). Further, it is also possible to provide a reinforcing member which is separate from the stopper plate (17, 37) and which is formed of hard resin or metal. For example, it is also possible to provide the key sheet (112, 122) with the stopper plate (17, 37) of the above embodiments.

It is also possible to adopt a structure in which the key tops are formed in the configuration of the key tops (13) of the first embodiment and in which the base sheet is formed in the configuration of the base sheet (46) of the third embodiment, with the fixation protrusions (13*b*) of the key tops (13) being fixed to the pedestal portions (46*d*) of the base sheet (46).

What is claimed is:

1. A key sheet, comprising:

a key top having a surface portion exposed through an operational opening formed in a casing of an apparatus, and a fixation protrusion protruding from a center of a bottom surface of the surface portion; and a base sheet which is formed of a rubber-like elastic material and which is equipped with a movable membrane, to which the fixation protrusion is fixed and which float-supports the key top to allow displacement of the key top through depression, and a support leg placed on a board, further comprising a stopper plate having an opening through which the fixation protrusion of the key top is passed and whose edge faces a side of the fixation protrusion, wherein, at a time of sidewise movement of the key top, the stopper plate abuts the key top to regulate the sidewise movement of the key top.

2. A key sheet according to claim 1, wherein, at the time of sidewise movement of the key top, the fixation protrusion abuts the opening edge of the stopper plate.

3. A key sheet according to claim 1, wherein the stopper plate is equipped with a threshold protrusion protruding from a surface of the stopper plate to a position beside the key top and regulating sidewise movement of the key top.

4. A key sheet according to claim 1, wherein, at a time of depressing operation on the key top, the movable membrane of the base sheet is separated from the stopper plate.

5. A key sheet according to claim 1, wherein the opening of the stopper plate is larger than the fixation protrusion and smaller than the key top.

6. A key sheet according to claim 1, wherein the stopper plate is placed on the base sheet without being fixed to the base sheet.

7. A key sheet according to claim 1, wherein both the stopper plate and the base sheet have mounting holes to be fit-engaged with positioning protrusions provided on the casing of the apparatus.

8. A key sheet according to claim 1, wherein a light shield layer is provided on a surface of the base sheet.

9. A key sheet according to claim 1, wherein a surface of the base sheet is level.

10. A key sheet according to claim 1, wherein the stopper plate is fixed to the support leg of the base sheet.

11. A key sheet according to claim 10, wherein a light shield layer is provided on the surface of the base sheet.

12. A key sheet according to claim 10, wherein the surface of the base sheet is level.

13. A key sheet according to claim 10, wherein both the stopper plate and the base sheet have mounting holes to be fit-engaged with positioning protrusions provided on the casing of the apparatus.

14. A key sheet, comprising:

a key top exposed through an operational opening (101*b*) formed in a casing of an apparatus; and a base sheet which is formed of a rubber-like elastic material and which is equipped with a fixation protrusion protruding from a surface and fixed to the key top, a movable membrane float-supporting the key top to allow displacement of the key top through depression, and a support leg placed on a board, further comprising a stopper plate having an opening through which the fixation protrusion of the base sheet is passed and whose edge faces a side of the fixation protrusion, wherein, at a time of sidewise movement of the key top, the stopper plate abuts the fixation protrusion to regulate the sidewise movement of the key top.

15. A key sheet according to claim 14, wherein, at the time of sidewise movement of the key top, the fixation protrusion abuts the opening edge of the stopper plate.

16. A key sheet according to claim 14, wherein the stopper plate is equipped with a threshold protrusion protruding from a surface of the stopper plate to a position beside the key top and regulating sidewise movement of the key top.

17. A key sheet according to claim 14, wherein at a time of depressing operation on the key top, the movable membrane of the base sheet is separated from the stopper plate.

18. A key sheet according to claim 14, wherein the opening of the stopper plate is larger than the fixation protrusion and smaller than the key top.

19. A key sheet according to claim 14, wherein the stopper plate is placed on the base sheet without being fixed to the base sheet.

20. A key sheet according to claim 14, wherein both the stopper plate and the base sheet have mounting holes to be fit-engaged with positioning protrusions provided on the casing of the apparatus.

21. A key sheet according to claim 14, wherein the light shield layer is provided on a surface of the base sheet.

22. A key sheet according to claim 14, wherein the stopper plate is fixed to the support leg of the base sheet.

23. A key sheet according to claim 22, wherein both the stopper plate and the base sheet have mounting holes to be fit-engaged with positioning protrusions provided on the casing of the apparatus.

24. A key sheet according to claim 22, wherein the light shield layer is provided on the surface of the base sheet.

* * * * *